US005476227A

United States Patent [19]

Tamura et al.

[11] Patent Number: 5,476,227

[45] Date of Patent: Dec. 19, 1995

[54] SELF-PROPELLED CRUSHING MACHINE

[75] Inventors: Yukio Tamura; Yasutaka Nishida, both of Kawasaki, Japan

[73] Assignee: Kabushiki Kaisha Komatsu Seisakusho, Tokyo, Japan

[21] Appl. No.: 211,912

[22] PCT Filed: Sep. 14, 1993

[86] PCT No.: PCT/JP93/01313

§ 371 Date: Apr. 22, 1994

§ 102(e) Date: Apr. 22, 1994

[87] PCT Pub. No.: WO94/06562

PCT Pub. Date: Mar. 31, 1994

[30] Foreign Application Priority Data

Sep. 14, 1992 [JP] Japan ..... 4-070014

[51] Int. Cl.[6] ..... B02C 21/02

[52] U.S. Cl. ..... 241/101.74; 241/186.35

[58] Field of Search ..... 241/101.7, 186.35, 241/186.4

[56] References Cited

U.S. PATENT DOCUMENTS

| | | | |
|---|---|---|---|
| 4,073,445 | 2/1978 | Clonch | 241/101.7 |
| 4,961,542 | 10/1990 | Den Besten et al. | 241/101.7 |
| 4,997,135 | 3/1991 | Zehr | 241/101.7 |
| 5,161,744 | 11/1992 | Schoop et al. | 241/101.7 |

FOREIGN PATENT DOCUMENTS

| | | |
|---|---|---|
| 63-77553 | 4/1988 | Japan . |
| 64-32744 | 3/1989 | Japan . |
| 3-130859 | 12/1991 | Japan . |

*Primary Examiner*—Mark Rosenbaum
*Assistant Examiner*—John M. Husar
*Attorney, Agent, or Firm*—Frishauf, Holtz, Goodman, Langer & Chick

[57] ABSTRACT

In a self-propelled crushing machine mounting an operator's platform (13), a hopper, (11) a crusher (8) coupled with the hopper and a driving power source (10) on a vehicular chassis (1) having a traveling device (19), the crusher (8) is provided at a longitudinally intermediate position of the vehicular chassis (1), the hopper (11) is located at the front side of the crusher, the driving power source (10) is located at the rear side of the crusher, the operator's platform (13) is located at one lateral side of the crusher, and a motor (24) for crusher is located at the other lateral side of the crusher. By this, the positions of the hopper (11), the engine (10) and the motor (24) can be low so that the overall height of the crushing machine can be low so as not to cause a problem in transportation by loading on the rear chassis of the truck. Also, since the hopper (11) is positioned at the frontwardly shifted position so that the operator's platform (13) will not serve as obstacles to improve efficiency in charging the object of crush into the hopper.

18 Claims, 5 Drawing Sheets

SELF-PROPELLED CRUSHING MACHINE

FIELD OF THE INVENTION

The present invention relates to a self-propelled crushing machine for crushing an object such as concrete waste and the like at a site of taking down a building.

BACKGROUND ART

As a conventional self-propelled crushing machine, there has been known the machine, in which an operator's cabin, a hopper, a crusher and a driving power source and so forth are mounted on a vehicular chassis provided with a pair of left and right traveling bodies, and a discharge conveyer is provided beneath the vehicular chassis in raisable fashion, as disclosed in Japanese Unexamined Utility Model Publication No. 64-32744 and Japanese Unexamined Patent Publication No. 63-77553.

These self-propelled crushing machines can travel by themselves and can finely crush the objects of crush, such as concrete wastes charged in the hopper, and discharge the crushed pieces out of the vehicular chassis through the discharge conveyer.

The self-propelled crushing machine disclosed in the first-mentioned publication has the operator's cabin at the front side of the vehicular chassis, the crusher at the longitudinal intermediate portion of the vehicular chassis and the driving power source at the rear position of the vehicular chassis. A charging inlet of the hopper connected to the crusher is positioned above the operator's cabin so that the hopper projects above the operator's cabin to make the overall height of the crushing machine tall. This results in a permissible height limit being exceeded when the crushing machine is transported by loading it on the rear chassis or carrier of a truck, to thereby cause a difficulty in transportation. Also, since the charging inlet of the hopper is located above the operator's cabin, the operator's cabin may obstruct charging of the object of crush by a loading machine, such as a power shovel and so forth from the front side of the vehicle to cause degradation of efficiency of the charging operation.

Also, in the self-propelled crushing machine disclosed in the later-mentioned publication, a part of the discharge conveyer extends outside of the vehicular chassis from the side of the driving power source. This requires a vertical clearance between the driving power source and the discharge conveyer. To pass the object of crush, it is necessary to make the height of the driving power source high in order to permit the required clearance. In addition a motor for the crusher is mounted above the driving power source. Therefore, the overall height of the crushing machine is such as to cause a similar problem with regard to its transportation as described above. Furthermore, since the gravity center of the vehicular chassis is placed at relatively high position, the stability of the vehicular chassis is degraded.

Therefore, it is an object of the present invention to provide a self-propelled crushing machine which is low in overall height so as not to exceed the permissible height limit when it is loaded on the rear chassis of a truck and, thus, not to cause a problem in its transportion, and an operator's cabin will not obstruct charging as a hopper is located and the front side of the operator's cabin and, thus, improves efficiency in the charging operation to the hopper by a loading machine of an object of crush.

DISCLOSURE OF THE INVENTION

In order to accomplish the above-mentioned and other objects, according to one aspect of the invention, a self-propelled crushing machine includes an operator's platform, a hopper, a crusher coupled with said hopper and a driving power source on a vehicular chassis having a traveling device. The crusher is provided at a longitudinally intermediate position of said vehicular chassis. The hopper is located at the front side of said crusher, and said driving power source is located at the rear end of said crusher. The operator's platform is located at one lateral side of said crusher. A motor for the crusher is located at the other.

With the construction set forth above, the positions of the hopper, the engine and the motor can be low so that the overall height of the crushing machine can be low so as not to cause a problem in transportation when it is loaded on the rear chassis of the truck. Also, since the hopper is positioned at the frontwardly shifted position so that the operator's platform will not be an obstacle to improve efficiency in charging the object of crush into the hopper.

In the construction set forth above, the traveling device may comprise a pair of left and right driving mechanisms, a discharge conveyer is arranged between said pair of left and right driving mechanisms, a part of said discharge conveyer is extended outward of said vehicular chassis and said traveling device at the opposite side of said driving power source.

Also, in the construction set forth above, since the part of the discharge conveyer is projected outward of the vehicular chassis and traveling device at a side opposite to the engine, it becomes unnecessary to provide a vertical clearance to pass the object of crush between the engine and the discharge conveyer so the height of the engine will not becomes too high.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

BEST MODE FOR IMPLEMENTING THE INVENTION

The preferred embodiment of a self-propelled crushing machine according to the present invention will be discussed with reference to FIGS. 1 to 5.

Figure 1:
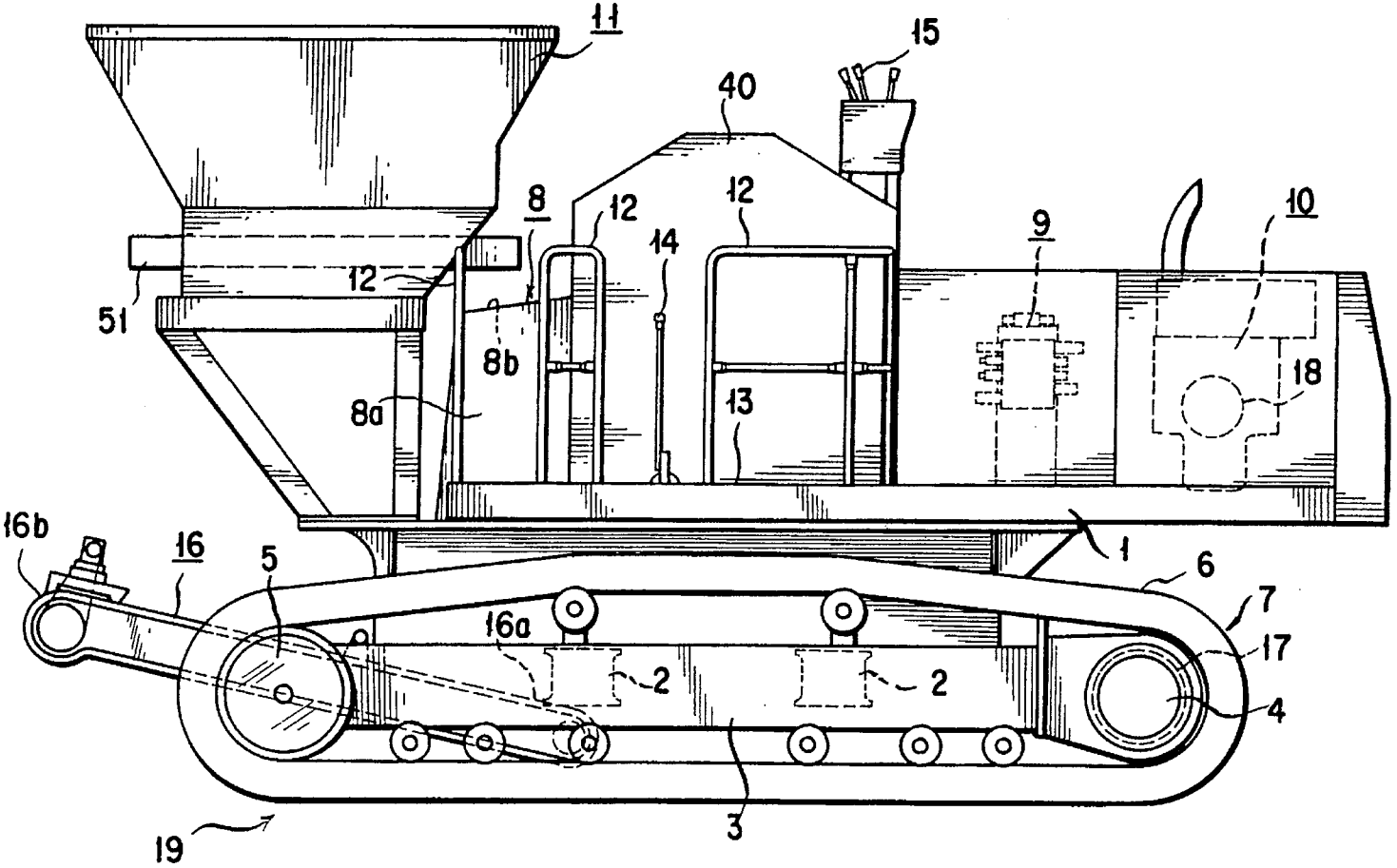
FIG. 1 is a side elevation of one embodiment of a self-propelled crushing machine according to the present invention.
Figure 2:
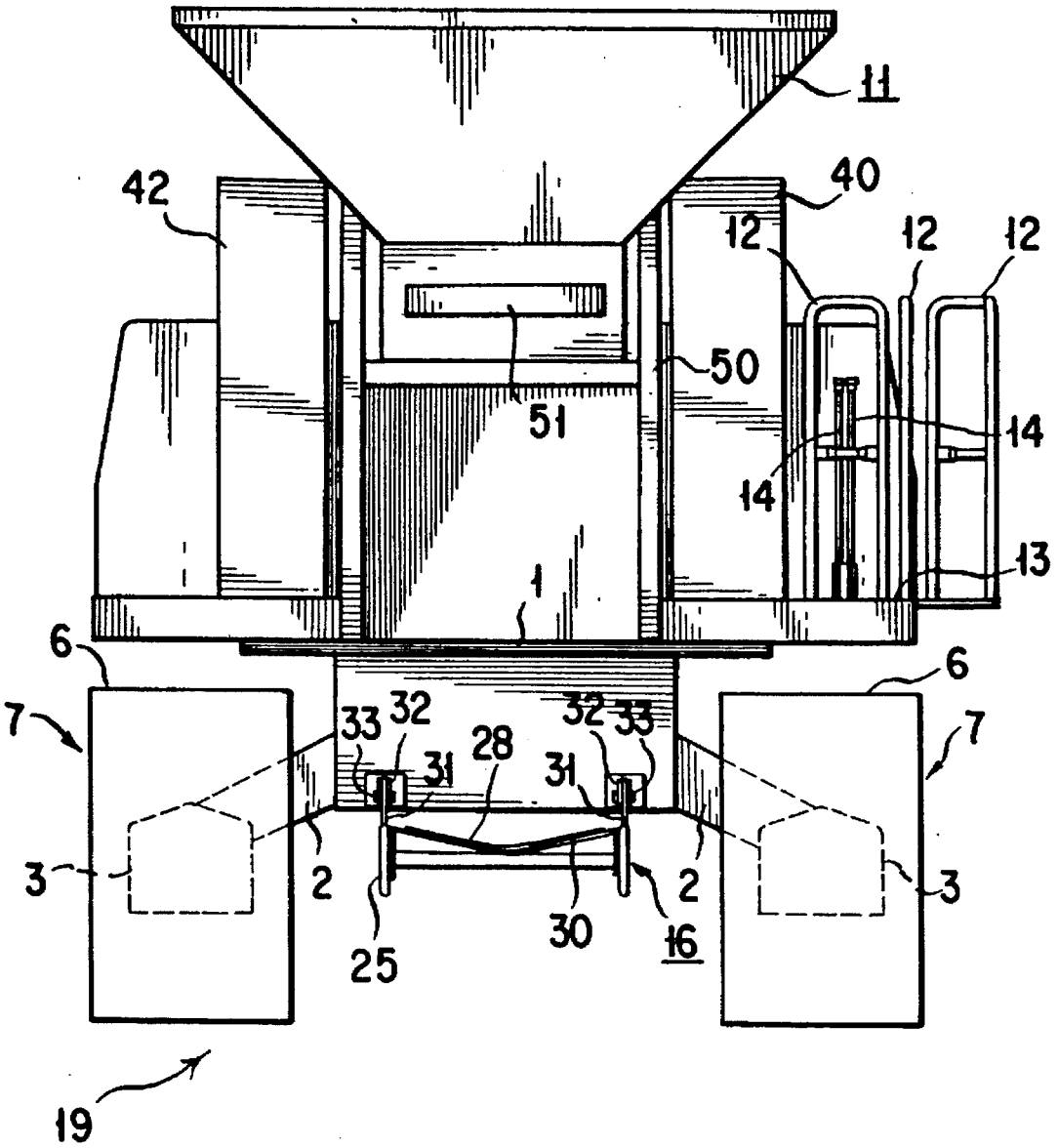
FIG. 2 is a front elevation of the above-mentioned embodiment.

As shown in FIG. 1 and 2, a pair of left and right truck frames 3, 3 is mounted on the lower left and right sides of a vehicular chassis 1 via cross members 2. On the truck frame 3, a hydraulic motor 17 and a sprocket 4 and an idler 5 driven by the hydraulic motor 17 are mounted. A crawler 6 is wound over the sprocket 4 and the idler 5 to form a crawler type drive mechanism 7. A pair of left and right drive mechanisms 7, 7 form a traveling device 19.

On the vehicular chassis 1, a hopper 11 is driven by a hydraulic motor, a crusher 8 which is connected to the hopper and driven by a hydraulic motor, an engine 10 for driving a hydraulic pump 18 which supplies a pressurized fluid to respective hydraulic motors and a valve group 9 for switching supply of the pressurized fluid from the hydraulic pump 18 to respective hydraulic motors are mounted. The crusher 8 is positioned at a longitudinally intermediate position on vehicular chassis 1. The hopper 11 is located at the front side of the crusher 8. The engine 10 is located at the rear side of the crusher 8. The valve group 9 is positioned at the intermediate position between the crusher 8 and the engine 10.

At a portion projecting sidewardly from one side surface 8*a* of the crusher 8 in the vehicular chassis 1, (see FIG. 3) is provided with a hand rail 12 to serve as an edge of operator's platform 13. A pair of left and right traveling levers 14, 14 are provided in the operator's platform 13. On the other hand, on a cover 40 located at the same side of crusher 8 and on the operator's platform 13, operation levers 15 for controlling the hopper 11 and the crusher 8 by operating the valve group 9 are provided.

Between a pair of the driving devices 7, 7, a discharge conveyer 16 is provided for vertical rocking motion. The inlet side 16*a* of the discharge conveyer 16 is located just beneath the discharge outlet of the crusher 8 (see FIG. 4) On the other hand, the outlet side 16*b* of the discharge conveyer projects frontwardly from the driving mechanisms 7, 7 and the vehicular chassis 1.

Next, the detail of respective parts will be discussed.

Figure 5:
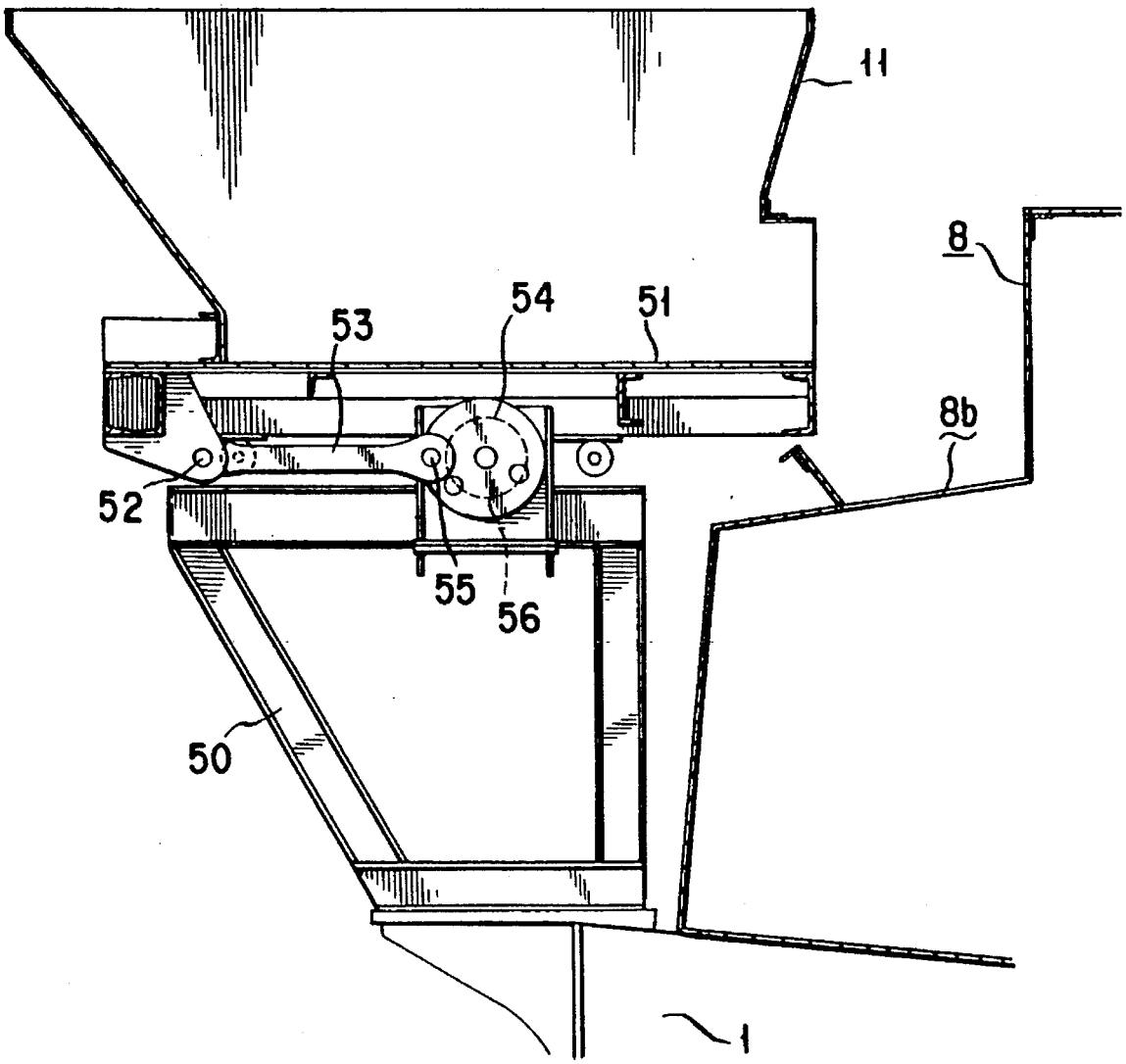
FIG. 5 is a section showing the detail of a hopper portion of the above-identified embodiment.

As shown in FIG. 5, the hopper 11 is mounted on a base 50 of the vehicular chassis 1. A bottom plate 51 of the hopper 11 is adapted to reciprocate toward and away from the charging inlet 8*b* of the crusher 8. On the other hand, one end of a connecting link 53 is connected to the bottom plate 51 via a pin 52. The other end of the connecting link 53 is connected to a circular plate 54 via a pin 55. The circular plate 54 is driven to rotate by means of a hydraulic motor 56.

When the circular plate 54 is driven to rotate, the bottom plate 51 is driven to reciprocate to feed the object of crush charged into the hopper 11 into the charging inlet 8*b* of the crusher 8.

Figure 3:
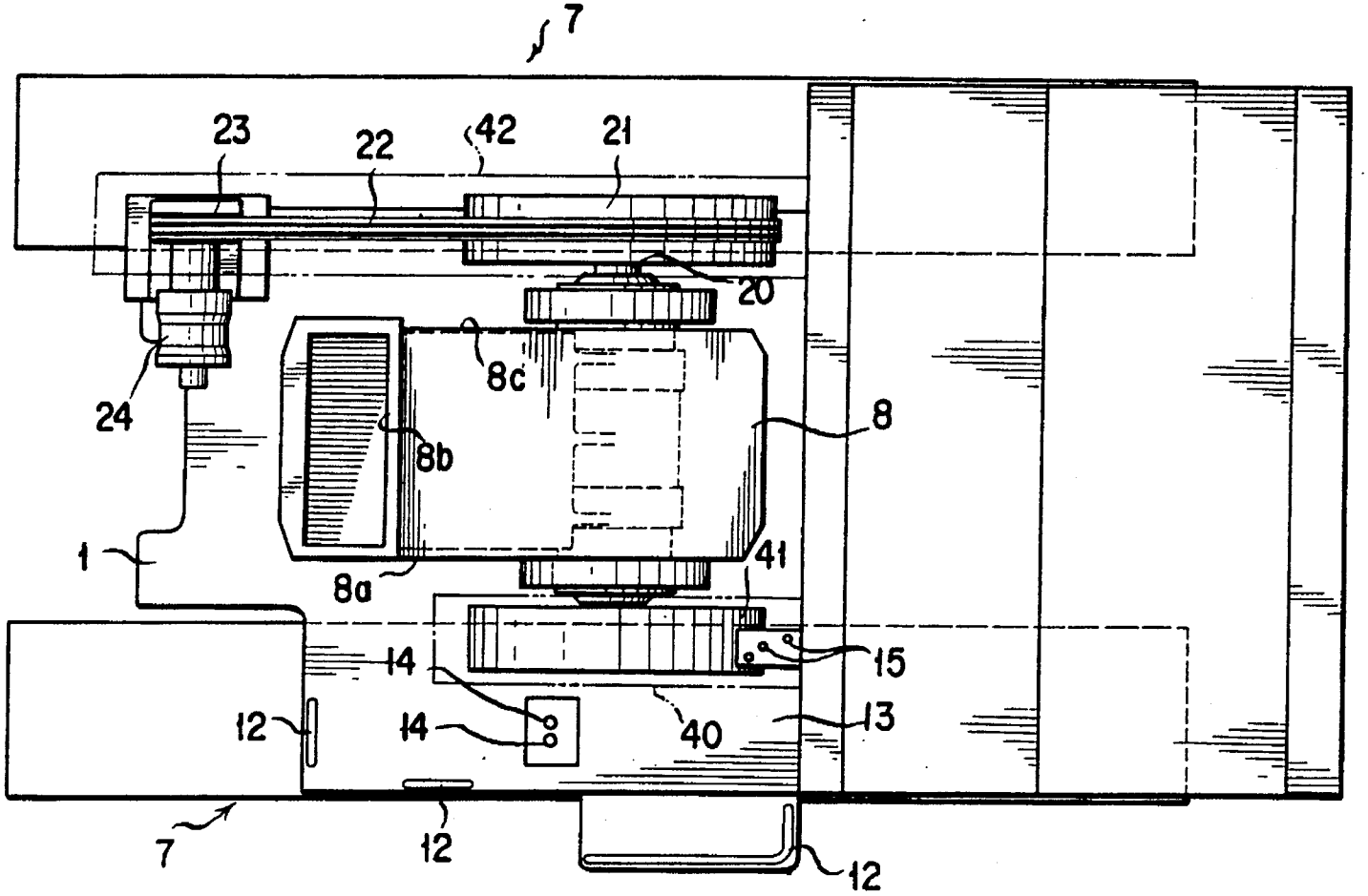
FIG. 3 is a plan view of the above-mentioned embodiment.

As shown in FIG. 3, the rotary shaft 20 of the crusher 8 is provided with a flywheel 41 at one end extending from the one side 8*a*. The other end of the rotary shaft is adapted to be driven by a hydraulic motor 24 via a pulley 21, a belt 22 and a pulley 23. The hydraulic motor 24 is positioned at the side or obliquely sideward position of the crusher 8 and at the opposite side to the operator's platform 13. The flywheel 41 is surrounded by the cover 40 at the one side. The pulley 21, the belt 22 and the pulley 23 are covered by a cover 42 at the other side.

Figure 4:
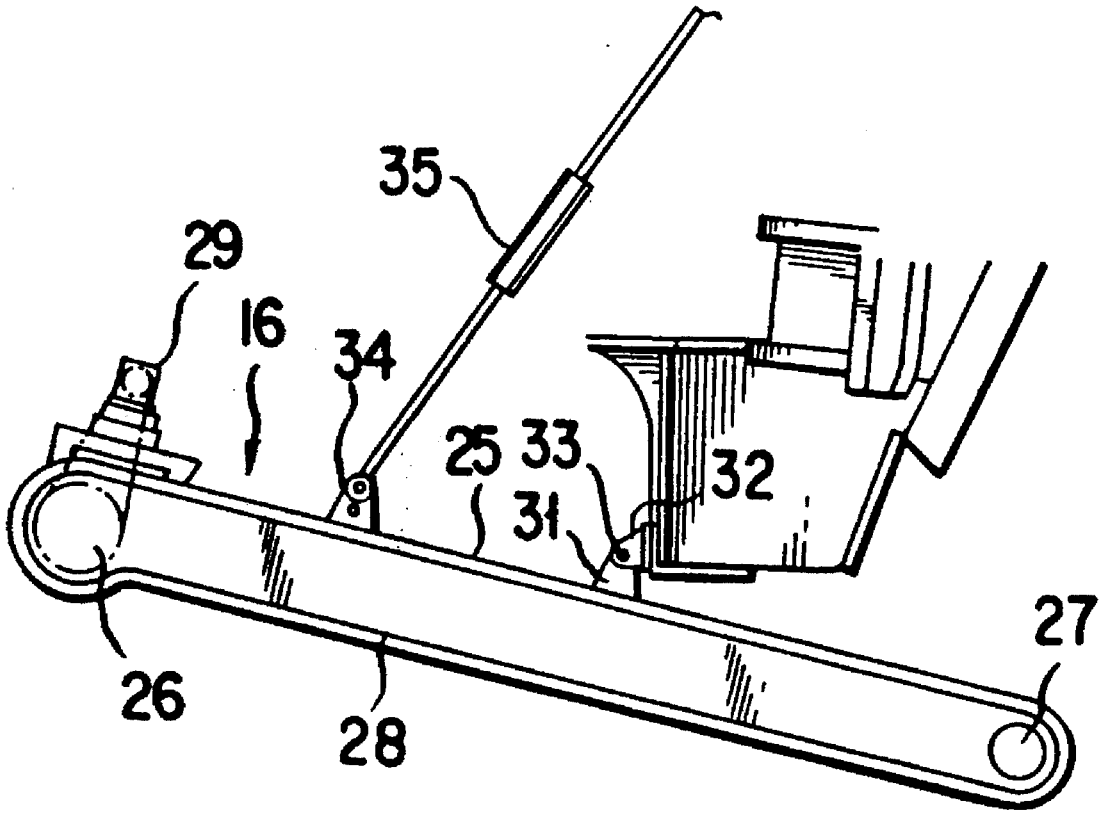
FIG. 4 is a side elevation showing the detail of a discharge conveyer portion of the above-mentioned embodiment.

As shown in FIGS. 2 and 4, the discharge conveyer 16 is provided with a drive pulley 26 and a driven pulley 27 on a frame 25 thereof. A belt 28 is wound around the drive pulley 26 and the driven pulley 27. The drive pulley 26 is adapted to be driven by a hydraulic motor 29. On the frame 25, a V-shaped belt guide 30 is provided so that the belt 28 may run through a V-shaped path. A supporting strip 31 fixed to the frame 25 is pivoted on a bracket 32 which is mounted on the vehicular chassis 1 for vertical pivotal movement about a pin 33. A receptacle piece 34 attached to the frame 25 is connected to the vehicular chassis 1 via a connecting member 35, such as a turn buckle, a rod, a wire or so forth. By adjusting the length of the adjusting member 35, the discharge conveyer 16 may rise and fall between an upwardly tilted position and a horizontal position.

Since the preferred embodiment is constructed as set forth above, the respective position of the hopper 11, the position of the engine 10 and the position of the hydraulic motor 24 can be low so that the overall height of the crushing machine can be low. Therefore, no problem will be encountered in transportation by loading the machine on the rear chassis of the truck. Also, since the hopper 11 is positioned at the frontwardly shifted position the operator's platform 13 and the traveling levers 14 will not serve as obstacles to improve efficiency in charging the object of crush into the hopper 11. Furthermore, since the part of the discharge conveyer 16 is projected outward of the vehicular chassis 1 and the traveling device 19 at the side opposite to the engine 10, it becomes unnecessary to provide a vertical clearance to pass the object of crush between the engine 10 and the discharge conveyer 16 so that the height of the engine 10 will not become too high.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments included within the scope of the invention as defined in the appended claims.

INDUSTRIAL APPLICABILITY

As set forth above, the self-propelled crushing machine according to the present invention is useful in facilitating its transport to respective construction sites, and efficiently crushing large objects from dismantled buildings, such as concrete blocks to be used for recycling.

We claim:

1. A self-propelled crushing machine comprising:

a vehicular chassis having a traveling device;

an operator's platform formed on said vehicular chassis;

a hopper;

a crusher mounted on said vehicular chassis and coupled with said hopper; and a driving power source mounted on said vehicular chassis;

said crusher is provided at a longitudinally intermediate position of said vehicular chassis;

said hopper is located at a front side of said crusher;

said driving power source is located at a rear side of said crusher;

said operator's platform is located at one lateral side of said crusher;

a motor for said crusher is located at the other lateral side of said crusher; and wherein said traveling device comprises a pair of left and right driving mechanisms, and a discharge conveyer is arranged between said pair of left and right driving mechanisms, a part of said discharge conveyer is extended outward of said vehicular chassis and beneath said hopper so that none of said crusher, driving power source and operator's platform intervenes therebetween so as to minimize overall height of the crushing machine.

2. A self-propelled crushing machine as set forth in claim 1, wherein said discharge conveyer is movable to rise and fall.

3. A self-propelled crushing machine comprising:

a mobile chassis suspended on a traveling device for self-propelled traveling;

an operator's platform defined on said mobile chassis for operator's operation of the crushing machine;

a motor powered crusher mounted on said mobile chassis for operation under control of the operator for object of crush charged thereinto;

a hopper mounted on said mobile chassis and coupled with said crusher for charging the object to be crushed;

a driving power source mounted on said mobile chassis and being coupled with said hopper and said crusher for providing the driving power thereto;

said hopper, said crusher and said driving power unit being arranged substantially in alignment and in that order along a longitudinal axis of said mobile chassis;

said operator's platform being arranged at a position laterally shifted from the line along which said hopper, said crusher and said driving power unit are aligned; and wherein said traveling device comprises a pair of left and right driving mechanisms provided substantially along left and right sides of said mobile chassis in mutually spaced apart relationship with a clearance, and which further comprises a discharge conveyer mounted to said mobile chassis below said hopper and within said clearance for discharging the crushed object discharged from said crusher, said hopper and said discharge conveyer being so arranged relative to each other that none of the operator's platform, crusher and driving power unit intervenes therebetween so as to minimize overall height of the crushing machine.

4. A self-propelled crushing machine as set forth in claim 3, wherein said discharge conveyer is mounted below said mobile chassis for rocking motion between an active position for discharging the crushed object discharged from said crusher and a resting position.

5. A self-propelled crushing machine as set forth in claim 4, wherein said discharge conveyer is pivotable mounted for rocking motion between said active position and resting position at the intermediate portion on the front end portion of said mobile chassis.

6. A self-propelled crushing machine as set forth in claim 5, wherein the front end of said discharge conveyer extends frontwardly beyond the front end of said mobile chassis and said hopper.

7. A self-propelled crushing machine as set forth in claim 3, which further comprises a motor coupled with said crusher and powered by said driving power unit for driving said crusher, said motor being arranged laterally shifted position from said line along which said hopper, said crusher and said driving power unit are aligned, at the opposite side to the side where said operator's platform is positioned.

8. A self-propelled crushing machine as set forth in claim 7, wherein said motor is longitudinally positioned substantially at the position where said crusher is located.

9. A self-propelled crushing machine as set forth in claim 3, wherein said operator's platform is longitudinally positioned substantially at the position where said crusher is located.

10. A self-propelled crushing machine comprising:

a mobile chassis suspended on a traveling device for self-propelled traveling, said traveling device comprises a pair of driving mechanisms provided substantially along left and right sides of said mobile chassis in mutually spaced apart relationship with a clearance;

an operator's platform defined on said mobile chassis for operator's operation of the crushing machine;

a motor powered crusher mounted on said mobile chassis for operation under control of the operator for object of crush charged thereinto;

a hopper mounted on said mobile chassis and coupled with said crusher for charging the object to be crushed;

a driving power unit mounted on said mobile chassis and coupled with said hopper and said crusher for providing the driving power thereto;

a discharge conveyer mounted to said mobile chassis within said clearance for rocking motion between an active position for discharging the crushed object discharged from said crusher and a resting position;

said hopper, said crusher and said driving power unit being arranged substantially in alignment and in that order along a longitudinal axis of said mobile chassis;

said operator's platform being arranged at a position laterally shifted from the line along which said hopper, said crusher and said driving power unit are aligned; and wherein said hopper and said discharge conveyer are so arranged relative to each other that none of the operator's platform, crusher and driving power unit intervenes therebetween so as to minimize overall height of the crushing machine.

11. A self-propelled crushing machine comprising:

a mobile chassis suspended on a traveling device for self-propelled traveling, said traveling device comprises a pair of driving mechanisms provided substantially along left and right sides of said mobile chassis in mutually space apart relationships with a clearance;

an operator's platform defined on said mobile chassis for operator's operation of the crushing machine;

a motor powered crusher mounted on said mobile chassis for operation under control of the operator for object of crush charged thereinto;

a hopper mounted on said mobile chassis and coupled with said crusher for charging the object to be crushed;

a driving power unit mounted on said mobile chassis and coupled with said hopper and said crusher for providing the driving power thereto;

a motor coupled with said crusher and powered by said driving power unit for driving said crusher;

a discharge conveyer arranged below said mobile chassis within said clearance for rocking motion between an active position for discharging the crushed object discharged from said crusher and a resting position;

said hopper, said crusher and said driving power unit being arranged substantially in alignment and in that order along a longitudinal axis of said mobile chassis;

said motor being arranged at a laterally shifted position from said line along which said hopper, said crusher and said driving power unit are aligned, at the opposite side to a side where said operator's platform is positioned;

said operator's platform being arranged at a position laterally shifted from the line along which said hopper, said crusher and said driving power unit are aligned; and wherein said hopper and said discharge conveyer are so arranged relative to each other that none of the operator's platform, crusher and driving power unit intervenes therebetween so as to minimize overall height of the crushing machine.

12. A self-propelled crushing machine comprising:

a chassis having an elongated platform defined by two opposite ends at its longitudinal extremes, and two lateral sides;

a pair of traveling devices attached to said chassis;

a hopper having a particular height and mounted directly to one end of said opposite ends of said platform so as to project above said platform by substantially only said hopper height;

a driving power unit mounted on said platform at the other end of said opposite ends;

a crusher and an operator's station mounted on said platform intermediate said hopper and said driving power unit; and a discharge conveyer mounted below said platform and disposed between said traveling devices at said one end of the platform;

said discharge conveyer and said hopper being arranged relative to each other without intervention of any of said crusher, said driving power unit or said operator's station so as to minimize overall height of the crushing machine.

13. The self-propelled crushing machine of claim 12, wherein said discharge conveyer is pivotally mounted to said platform for vertical rocking motion between an active position and a resting position.

14. The self-propelled crushing machine of claim 13, wherein said discharge conveyer has an end protruding forwardly of said one end of the platform.

15. The self-propelled crushing machine of claim 14, wherein said protruding end of said discharge conveyer is for discharging objects crushed by said crusher, when said discharge conveyer is in said active position.

16. The self-propelled crushing machine of claim 12, wherein a motor for said crusher and said operator's station are at opposite ones of said sides of the platform.

17. The self-propelled crushing machine of claim 16, wherein said hopper, crusher and driving power source are substantially in longitudinal alignment on said platform.

18. The self-propelled crushing machine of claim 12, wherein said hopper, crusher and driving power source are substantially in longitudinal alignment on said platform.

* * * * *